United States Patent [19]

Mule

[11] 4,386,723

[45] Jun. 7, 1983

[54] FIREARM SLING ATTACHMENT

[76] Inventor: Carmine P. Mule, 596 Lake Dr. East, Lake Peekskill, N.Y. 10537

[21] Appl. No.: 267,398

[22] Filed: May 26, 1981

[51] Int. Cl.[3] ..... A45F 5/02; F41C 33/00

[52] U.S. Cl. ..... 224/150; 24/204; 24/306; 224/264; 224/901

[58] Field of Search ..... 224/150, 149, 913, 203, 224/205, 257, 264, 901, 226, 191, 192, 198; 24/204, 306

[56] References Cited

U.S. PATENT DOCUMENTS

| | | | |
|---|---|---|---|
| 1,027,527 | 5/1912 | Davis | 224/264 X |
| 2,748,390 | 6/1956 | Carlson | 224/264 X |
| 3,052,886 | 9/1962 | White | 224/264 X |
| 3,083,885 | 4/1963 | Ware | 224/264 X |
| 3,099,884 | 8/1963 | Kixmiller et al. | 2/DIG. 6 |
| 4,165,826 | 8/1979 | Chica | 224/191 |

*Primary Examiner*—Allan N. Shoap
*Assistant Examiner*—Robert M. Petrik
*Attorney, Agent, or Firm*—Spellman & Joel

[57] ABSTRACT

A firearm sling keeper comprises a channel member which completely encloses a small segment of the doubled sling strap and is fixed to the stock of the arm by means of conventional sling swivels at the toe of the butt stock and toward the muzzle end of the stock forearm. The sling strap is free to move longitudinally through the channel member in response to a shift of the center of gravity of the slung firearm. The exterior surface of the channel member opposite to and facing the stock forearm has a large number of small plastic hooks, comprising one-half of a Velcro-type fastener. The mating eye portion of the Velcro-type fastener is located on a fabric and/or plastic patch which is detachably mounted to the user's garment by means of a lockable pin device or fastener secured firmly to, or incorporated into, the patch. The channel member slides longitudinally along the sling, which is held in a fixed position on the firearm, and need not be repositioned to compensate for shifts of position or changes of pace by the user. The sling device thus permits the user to securely sling his firearm without the risk that it will fall off his shoulder when the free use of his hands is necessary. It is convenient and comfortable and permits the rapid unslinging of the firearm when desired.

8 Claims, 3 Drawing Figures

FIG.1
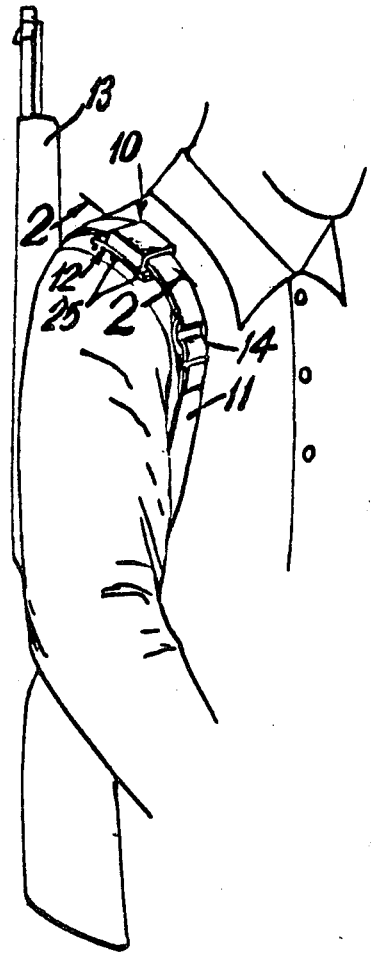
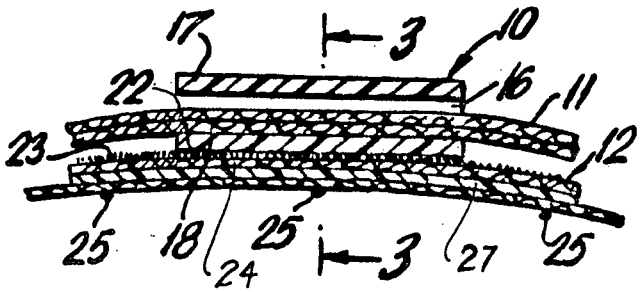
FIG.2
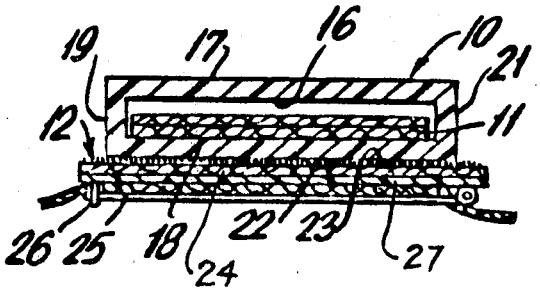
FIG.3

FIREARM SLING ATTACHMENT

BACKGROUND OF THE INVENTION

This invention relates to gun sling attachments and particularly to a firearm attachment which readily and detachably attaches to the user's clothing to prevent shifting of the sling.

The prior art includes U.S. Pat. No. 3,319,852 to Perkins directd to an adjustable gun sling where the length of the sling is adjusted by a combination of VELCRO material including hooks and eyes. Perkins U.S. Pat. No. 3,664,560 disclosed a "Sam Browne Belt" worn over either unbelted trousers or trousers secured with a belt having a section of VELCRO material on the outer surface thereof and a mating section at the end of the inner surface for securing the belt in an overlapping arrangement.

Additional prior art includes U.S. Pat. No. 4,165,826 to Chica which discloses a holster and belt combination wherein the holster is secured in position by a combination of VELCRO strips on the holster and the inner surface of the wearer's belt. Devlin U.S. Pat. No. 4,022,361 also relates to a holster having VELCRO pads secured to the wearer's belt or garment. Somewhat more remote is the holster shown in U.S. Pat. No. 3,910,469 to Baldocci which again utilizes VELCRO strips for positioning the holster on user's body.

While the prior art appears to disclose the use of VELCRO-type strips in conjunction with gun belts, where is no disclosure of a unique gun sling wherein a portion of the VELCRO material is located on the inner surface of the sling and the wearer has a patch of mating material detachably or permanently attached to his garment. As a result, the sling does not move on the wearer's shoulder and permits him to have two free hands.

SUMMARY OF THE INVENTION

The present invention pertains to a firearm sling attachment and comprises a first member which is mounted to the user's garment and a second mating member on the sling. The two members may be removably mounted to one another by a hook or loop and eye combination. The portion attached to the sling comprises a channel-shaped member having a central aperture and including a hook or eye suface of a VELCRO fastener type on the interior surface thereof. The second member having the mating portion of the VELCRO-type fastener is located on a fabric patch which is detachably secured to the user's shoulder by a lockable pin or pins. In use, the mating hook and eye fastener combination is engaged to prevent the sling from sliding on the wearer's shoulder and freeing his hands for other purposes.

Accordingly, an object of this invention is to provide a new and improved firearm sling attachment.

Another object of this invention is to provide a new and improved firearm sling attachment which detachably engages the wearer's garment.

A more specific object of this invention is to provide a new and improved firearm sling attachment wherein a channel-shaped member with the sling passing therethrough includes a fastener surface which engages a mating fastener surface removably mounted on the wearer's garment so that the sling is firmly held in place during movement by the wearer.

BRIEF DESCRIPTION OF THE DRAWINGS

Other objects and advantages of the present invention may be seen from the following description when viewed in conjunction with the accompanying drawings wherein:

FIG. 1 shows a perspective view of the firearm sling attachment in use;

FIG. 2 is a cross-sectional view of the channel-shaped member comprising one portion of the sling attachment taken along the line 2—2 of FIG. 1; and , FIG. 3 is a cross-sectional view of the mating fastener member which is affixed to the wearer and comprises a second portion of the sling attachment.

DETAILED DESCRIPTION OF THE INVENTION

Referred now to the drawings, the firearm sling attachment of the present invention comprises two cooperating members, a channel-shaped member 10 which fits about the sling 11 and a member 12 which is mounted to the user's garment. The sling itself 11 is attached to the firearm 13 in a conventional manner and includes means 14 to lengthen or shorten the effective length of the sling 11. Normally, however, the sling 11 tends to shift on the wearer's shoulder during movement, requiring constant adjustment and causing considerable annoyance. It is also difficult to have both hands continuously free during movement when the firearm 13 is continuously shifting.

The channel-shaped member 10 includes parallel upper and lower surfaces, 17 and 18, joined by vertical surfaces 19 and 21 to form an aperture 16 for passage of the doubled sling strap 11. The diameter or width of the channel member 10 will vary from $\frac{7}{8}$ inch, to 1 inch or even up to $1\frac{1}{4}$ inches, depending upon the width of the sling 11. The length of a typical member 10 is approximately two inches although probably closer to 1" in a preferred embodiment.

The surfaces 17, 18, 19 and 21 of the channelled, elliptically shaped member 10 are of material such as vinyl. Consequently, the surfaces 17–21 are flexible and in use may not maintain their precise parallel relationship. The interior surface 18 includes a VELCRO hooks surface integrally molded thereto. The hooks or loops 22 are designed to engage the eyes 23 on member 12.

The member 12 comprises a fabric surface 24 having the vinyl backing 27 with the eyes 23 molded thereto. A plurality of pins 25 which fit into a blocking latch or catch 26, such as used on military ribbons is used to connect the member 12 to the user's garment. The catches 26 are generally fused into the vinyl backing of the VELCRO surface 23.

In use, the member 12 is attached to the user's garment (hunting shirt, combat blouse, hunting or shooting jacket, field jacket, etc.). The pins 25, or a similar locking device, fused into the vinyl backing 27 of the VELCRO eyes 23 are connected to the garment in the desired position. The member 12 is thus firmly attached to the garment by its readily removable fastener or can be shifted to another position as the position or motion of the carrier changes.

The movable portion of the firearm sling attachment comprises a sleeve-like member 10 which has an opening 16 facing towards the butt and muzzle of the long arm 13. The member 10 is free to move along the sling 11 to accommodate any change in the carrier's position with an immediate, reciprocal change in the position of the long arm. The mating hooks 22 and eyes 23 of members 10 and 12 are joined together to prevent the sling from moving on the wearer's shoulder or slipping off. The area of the mating surfaces 10 and 12 as well as the type for hooks and loops is determined by the conditions of use. The use of the firearm with the device should be as easy as with no device since the sling device holds no weight but merely keeps the slung firearm in place. When it is desired to unsling the firearm, the mated members of the attachment device are easily separated with minimal force, separating the hooks and eyes of the VELCRO material.

It is understood that the above-described arrangements are merely illustrative examples of the application. Numerous other arrangements may be readily devised by those skilled in the art which will embody the principles of the invention and fall within the spirit and scope thereof.

What is claimed is:

1. A firearm sling device for mounting to a user's garment comprises:

a channel member which surrounds a small segment of the sling which is affixed at its ends to the firearm and through which the sling is free to move, the exterior surface of said member facing towards the firearm having a plurality of small plastic hooks, and, a patch detachably mounted to the user's garment having a plurality of mating eye portions on the outer surface thereof to engage the hooks on the channel member whereby the sling slides longitudinally through the channel member as the user changes position but at the same time maintains the firearm securely in position so that the user's hands are free and yet permits rapid unslinging of the firearm by forcing the hooks and eyes apart.

2. A firearm sling device in accordance with claim 1 wherein:

the patch comprises a member having fastening means incorporated into the body thereof for attachment to the user's garment.

3. A firearm sling device in accordance with claim 2 wherein:

the path comprises a fabric or plastic member having a lockable pin incorporated therein and extending outwardly for attachment to the user's garment.

4. A firearm sling device in accordance with claim 1 wherein:

the plastic hook surface on the channel member and the mating eye portion on the patch comprise a VELCRO-type fastener.

5. A firearm sling device in accordance with claim 1 wherein:

the channel member includes spaced substantially parallel upper and lower surfaces joined by end surfaces to form an aperture for passage of the sling.

6. A firearm sling device in accordance with claim 5 wherein:

the width of the aperture ranges from approximately $\frac{7}{8}$ inches to $1\frac{1}{4}$ inches and the length of the channel member ranges from approximately 1 inch to 2 inches.

7. A firearm sling device in accordance with claim 1 wherein:

the channel member comprises a vinyl plastic material and the patch comprises a vinyl backed member having the eyes fused into the surface thereof.

8. A firearm sling device in accordance with claim 1 wherein:

the exterior surface of the channel member facing the firearm includes a plurality of small plastic loops or eyes, and, the patch includes a plurality of mating plastic hooks on the outer surface thereof.

* * * * *